US006408598B1

(12) United States Patent
Stockley, III

(10) Patent No.: US 6,408,598 B1
(45) Date of Patent: Jun. 25, 2002

(54) MODIFIED ATMOSPHERE PACKAGE FOR HIGH PROFILE PRODUCTS FROM UPWARDLY FORMED HEAT SHRINKABLE FILM

(75) Inventor: H. Walker Stockley, III, Spartanburg, SC (US)

(73) Assignee: Cryovac, Inc., Duncan, SC (US)

( * ) Notice: Subject to any disclaimer, the term of this patent is extended or adjusted under 35 U.S.C. 154(b) by 0 days.

(21) Appl. No.: 09/220,270

(22) Filed: Dec. 23, 1998

(51) Int. Cl.[7] ..... B65B 31/00
(52) U.S. Cl. ..... 53/433; 53/427
(58) Field of Search ..... 53/427, 509, 447, 53/432, 433; 206/213.1, 497; 426/129, 396, 415

(56) References Cited

U.S. PATENT DOCUMENTS

| | | | | | |
|---|---|---|---|---|---|
| 3,534,521 | A | | 10/1970 | Rorer | 53/22 |
| 3,634,993 | A | | 1/1972 | Pasco et al. | 53/22 A |
| 3,694,991 | A | | 10/1972 | Perdue et al. | |
| 3,695,900 | A | | 10/1972 | Young et al. | 99/174 |
| 3,709,702 | A | | 1/1973 | Mahaffy et al. | 99/174 |
| 3,835,618 | A | | 9/1974 | Perdue | 53/112 A |
| 4,055,672 | A | | 10/1977 | Hirsch et al. | 426/127 |
| 4,058,953 | A | | 11/1977 | Sanborn, Jr. et al. | 53/22 A |
| 4,085,565 | A | | 4/1978 | Mahaffey et al. | 53/112 A |
| 4,145,863 | A | | 3/1979 | Hannon | 53/22 A |
| RE30,009 | E | | 5/1979 | Perdue et al. | 53/433 |
| 4,321,997 | A | | 3/1982 | Miller | 206/204 |
| 4,611,456 | A | * | 9/1986 | Gillio-tos et al. | 53/427 |
| 4,796,408 | A | * | 1/1989 | Mobark | 53/427 |
| 4,833,862 | A | | 5/1989 | Bortolani et al. | 53/427 |
| 4,840,271 | A | | 6/1989 | Garwood | 206/213.1 |
| 4,886,690 | A | | 12/1989 | Davis et al. | 428/36.6 |
| 4,889,731 | A | | 12/1989 | Williams, Jr. | 426/106 |
| 4,919,955 | A | | 4/1990 | Mitchell | 426/394 |
| 4,927,691 | A | | 5/1990 | Bekele | 428/35.2 |
| 4,956,212 | A | | 9/1990 | Bekele | 428/36.6 |
| 5,033,253 | A | * | 7/1991 | Havens et al. | 53/427 |
| 5,155,974 | A | | 10/1992 | Garwood | 53/510 |
| 5,158,836 | A | | 10/1992 | Schirmer et al. | 428/336 |
| 5,219,666 | A | | 6/1993 | Schirmer et al. | 428/521 |
| 5,226,531 | A | | 7/1993 | Garwood | 206/213.1 |
| 5,298,202 | A | | 3/1994 | Schirmer | 264/22 |
| 5,346,735 | A | | 9/1994 | Logan et al. | 428/36.7 |
| 5,402,622 | A | * | 4/1995 | Stockley et al. | 53/427 |
| 5,462,756 | A | | 10/1995 | Raines et al. | 426/129 |
| 5,591,468 | A | | 1/1997 | Stockley, III et al. | 426/106 |
| 5,736,260 | A | * | 4/1998 | Hayashida et al. | 426/396 |
| 5,779,050 | A | * | 7/1998 | Kocher et al. | 206/497 |
| 5,919,547 | A | | 7/1999 | Kocher et al. | 428/138 |

FOREIGN PATENT DOCUMENTS

| | | | |
|---|---|---|---|
| AU | 702738 | | 6/1994 |
| DE | 2240234 | | 3/1973 |
| EP | 0 248 601 | | 5/1987 |
| FR | 1258357 A | * | 3/1961 |
| NZ | 280804 | | 1/1996 |
| ZA | 92/2661 | | 12/1992 |

* cited by examiner

*Primary Examiner*—Stephen F. Gerrity

(57) ABSTRACT

A packaging process is disclosed which includes the steps of providing a tray, providing an upper film which includes a sealant layer which is sealable to the tray, orienting the film to an orientation ratio of from about 6.0:1 about 16.0:1 positioning, a high profile product on the tray, extending the upper film above the tray and product, drawing the upper film into a concavity by differential pressure, maintaining the concave shape of the upper film while heating the film, removing gases from the space between the upper film and the tray and product, introducing a desirable gas into the space, releasing the upper film such that it shrinks toward the product and the tray while the desirable gas is retained within the space and prevents close contact of the film with the lowermost portions of the product, and sealing the upper film to the flange of the tray, wherein at least the step of heating the film shrinks the film, thereby tensioning it onto and across the underlying product. The resultant package of the high profile product provides an in-store overwrap appearance.

8 Claims, 5 Drawing Sheets

MODIFIED ATMOSPHERE PACKAGE FOR HIGH PROFILE PRODUCTS FROM UPWARDLY FORMED HEAT SHRINKABLE FILM

BACKGROUND OF THE INVENTION

It is common practice in packaging many goods, including food items and particularly, meat products, to use a substantially rigid tray and a flexible, polymeric upper lid. During the packaging process, the product is placed in the tray. The lidding material is fed from a roll across the tray, covers the product, and typically is sealed to the tray edges to form the finished package. However, relatively bulky or awkwardly shaped products which extend above the upper flange of a conventional packaging tray, i.e., high profile products, are not readily accommodated by such a packaging operation.

High profile meat products are regularly packaged in supermarkets in an in-store overwrap process. By such process, the high profile product is placed in a tray, a polymeric film is stretched around the product and tray, and then the overwrapped tray is pressed onto a heated plate to weld together the pleats and folds of the film at the underside of the tray. The resultant package, an upper film tensioned across the uppermost portions of the high profile product and extending, under tension, to the outer edges of the tray, is readily recognized by consumers. Yet, the preparation of such packages on an individual basis has long been recognized to be inefficient and expensive. Instead, it is preferable to butcher and package such meat products at a central processing facility which benefits from economies of scale, and then ship the packaged meat to individual supermarkets or other retail outlets. It is believed that the central processing of meat can also lead to a higher quality, more sanitary product with a longer shelf-life than meat which is butchered and packaged in individual supermarkets.

One method for providing centrally packaged high profile meat products has been vacuum skin packaging (VSP). In a typical vacuum skin packaging process, the product is placed on a support member, a thermoformable film is extended over product and support member, the film is drawn upwardly into a cavity above the product and heated to its softening temperature, the space between the upwardly drawn film and the product and support member is evacuated and the heated film is released onto the product, thermoforming itself to the product and welding to the remaining upper surface area of the support member.

Vacuum skin packaging is an excellent packaging process for a variety of products.

However, there are some drawbacks to vacuum skin packaging high profile products. First, it can be difficult to provide an upper VSP film which is capable of being sufficiently drawn to accommodate an irregularly shaped high profile product without undue thinning and potential breakage in the crevices of the product or without unsightly folds and pleats in the film where it welds to the support member. Second, even a perfectly vacuum skin packaged high profile product can present an unusual and, therefore, less preferred appearance to consumers who are accustomed to the appearance of in-store overwrapped packages.

The concerns with packaging a high profile product are exacerbated when the product is one, as is the case for many meat products, which must be packaged under certain environmental conditions. For example, for some meat products it is desirable to package and distribute the meat in a low oxygen environment and then expose the meat to a high oxygen environment immediately prior to presentation for sale. For such meat products a substantially gas-impermeable lidding film which peelably delaminates (i.e., delaminates upon peeling) to expose a gas-permeable film, thereby causing a change in the environmental conditions within the package is often employed.

As is discussed above, historically, large sub-primal cuts of meat have been butchered and packaged in each supermarket. Fresh red meat presents a particular challenge to the concept of centralized processing and packaging due to its oxygen-sensitivity. Such oxygen-sensitivity is manifested in the shelf-life and appearance (color) of a packaged meat product. For example, while a low-oxygen packaging environment generally increases the shelf-life of a packaged meat product (relative to meat products packaged in an environment having a higher oxygen content), red meat has a tendency to assume a dark red color when packaged in the absence of oxygen or in an environment having a very low oxygen concentration, i.e., below about 5% oxygen. Unfortunately, such a dark red color is undesirable to most consumers, and marketing efforts to teach the consumer about the acceptability of the dark red color have been largely ineffective. When meat is exposed to a sufficiently high concentration of oxygen, e.g., as found in air, it assumes a bright red color which most consumers associate with freshness. After 1 to 3 days of such exposure, however, meat assumes a brown color which, like. the dark red color, is undesirable to most consumers (and indicates that the meat is beginning to spoil).

Thus, in order to effectively butcher and package meat products in a central facility for distribution to retail outlets, the meat would desirably be packaged, shipped, and stored in a low-oxygen environment for extended shelf-life, and then displayed for consumer sale in a relatively high-oxygen environment such that the meat is caused to "bloom" into a red color just before being placed in a retail display case. While in the retail display case, the meat product is desirably contained in a package which protects it from microbial and other contamination. In order to attain the maximum economic benefit from centralized packaging, the package in which the meat product is displayed for consumer sale is the same package in which the meat product is initially packaged and shipped from the central processing facility.

Accordingly, there is a need in the art for a package and process for centrally packaging high profile products which provides a conventional package appearance and which may be employed for environment-sensitive products.

SUMMARY OF THE INVENTION

Such need is met by a packaging process which includes the steps of providing a support member which includes a product support surface and a periphery, providing an upper film which includes a sealant layer, the sealant layer being sealable to the support member, orienting the film to an orientation ratio of from about 9.0:1 to about 16.0:1, positioning a product on the product support surface of the support member such that at least a portion of the product extends upwardly above the level of the periphery, extending the upper film above the support member and product, the sealant layer being immediately above and adjacent to the support member and the product, drawing the upper film into a concavity by differential pressure, maintaining the concave shape of the upper film while heating the film, removing gases from the space between the upper film and the support member and product, introducing a desirable gas into the space, releasing the upper film such that it shrinks toward the product and the support member, the desirable gas being retained within the space precluding close contact of the film with the lowermost portions of the product, and sealing the upper film to the periphery of the support member, wherein at least the step of heating the film shrinks the film, thereby tensioning it onto and across the underlying product.

This need is also met by providing a package which includes a support member which includes a product support surface and a periphery, a product contained on the product support surface, at least a portion of the product extending upwardly above the level of the periphery, an oriented upper film tensioned across and at least partially heat shrunk onto the uppermost portions of the product and sealed to the periphery of the support member, and a desired gas trapped between the support member and the upper film.

DEFINITIONS

As used herein, the term "film" refers to a thermoplastic material, generally in sheet or web form, having one or more layers formed from polymeric or other materials. A film can be a monolayer film (having only one layer) or a multilayer film (having two or more layers).

As used herein, the term "multilayer" refers to film comprising two or more layers which are bonded together by one or more of the following methods: coextrusion, extrusion coating, vapor deposition coating, solvent coating, emulsion coating, or suspension coating.

As used herein, the terms "extrusion," "extrude," and the like refer to the process of forming continuous shapes by forcing a molten plastic material through a die, followed by cooling or chemical hardening. Immediately prior to extrusion through the die, the relatively high-viscosity polymeric material is fed into a rotating screw, which forces it through the die.

As used herein, the term "coextrusion," "coextrude," and the like refer to the process of extruding two or more materials through a single die with two or more orifices arranged so that the extrudates merge and weld together into a laminar structure before chilling, i.e., quenching. Coextrusion can be employed in film blowing, free film extrusion, and extrusion coating processes.

As used herein, the term "layer" refers to a discrete film component which is coextensive with the film and has a substantially uniform composition. In a monolayer film, tile "film" and "layer" would be one and the same.

As used herein, the terms "delaminate," "delaminates," and the like refer generally to the internal separation of a film or laminate and, more specifically, to the separation of a coextruded, multilayer film within a layer and/or at an inter-layer (i.e., layer/layer) interface within the coextruded film when such film, or laminate of which the coextruded film is a component, is subjected to a peel force of sufficient magnitude.

As used herein, the term "intra-film cohesive strength" refers to the internal force with which a film remains intact, as measured in a direction that is perpendicular to the plane of the film. In a multilayer film, intra-film cohesive strength is provided both by inter-layer adhesion (the adhesive strength between the layers which binds them to one another) and by the intra-layer cohesion of each film layer (i.e., the cohesive strength of each of the film layers). In a monolayer film, intra-film cohesive strength is provided only by the intra-layer cohesion of the layer which constitutes the film.

As used herein, the terms "peel," "peeling," and the like refer generally to the act of removing one or more layers from a multilayer film by manually grasping and pulling back the layers along a plane or interface of relatively low bond-strength or within a layer having relatively weak intra-layer cohesion.

As used herein, the term "peel force" refers to the amount of force required to ply-separate two layers, and/or internally separate one layer, of a multilayer film or laminate, as measured in accordance with ASTM F904-91.

As used herein, the term "bond-strength" refers generally to the adhesive force with which two adjacent films, or two adjacent film layers, are connected and, more specifically, to the force with which two films are connected by a heat-weld. Bond-strength can be measured by the force required to separate two films or film layers that are connected, e.g., via a heat-weld, in accordance with ASTM F88-94.

As used herein, the phrase "gas-permeable" refers to a film or film portion which admits at least about 1,000 cc of gas, such as oxygen, per square meter of film per 24 hour period at 1 atmosphere and at a temperature of 73° F. (at 0% relative humidity). More preferably, a gas-permeable film or film portion admits at least 5,000, even more preferably at least 10,000, such as at least 15,000, 20,000, 25,000, 30,000, 35,000, 40,000, and 50,000, and most preferably at least 100,000 cc of oxygen per square meter per 24 hour period at 1 atmosphere and at a temperature of 73° F. (at 0% relative humidity). In accordance with the present invention, a gas-permeable film or film portion can itself have the aforedescribed levels of gas permeability or, alternatively, can be a film or film portion which does not inherently possess the aforedescribed levels of gas permeability but which is altered, e.g., perforated or peelably delaminated, to render the film gas-permeable as defined above.

As used herein, the phrase "substantially gas-impermeable" refers to a film or film portion which admits less than 1000 cc of gas, such as oxygen, per square meter of film per 24 hour period at 1 atmosphere and at a temperature of 73° F. (at 0% relative humidity). More preferably, a substantially gas-impermeable film admits less than about 500, such as less than 300, and less than 100 cc of gas, more preferably still less than about 50 cc, and most preferably less than 25 cc, such as less than 20, less than 15, less than 10, less than 5, and less than 1 cc of gas per square meter per 24 hour period at 1 atmosphere and at a temperature of 73° F. (at 0% relative humidity).

As used herein, the phrase "product support member" refers to a component of a package on or in which a product is disposed. Meat products are typically disposed in a tray-like package component comprising, e.g., expanded polystyrene sheet material which has been thermoformed into a desired shape, for supporting the meat product. The support member of the present inventive package may be flat or substantially planar but is preferably formed in the shape of a tray, That is, the support member necessarily includes a product support surface for receiving and supporting the product being packaged and a periphery to which the upper film is sealed. Preferably, the support member includes a downwardly formed cavity and an upper flange, wherein the product support surface is defined by the downwardly formed cavity and wherein the upper flange is the periphery of the support member.

The support member may be semi-rigid but is preferably rigid. It may be thermoformed in-line with the packaging operation or provided preformed. Depending on the product being packaged and the ultimate end-use application the support member may be gas permeable or substantially gas impermeable. Depending on the composition of the sealant layer of the upper film and, optionally, the desired gas barrier properties of the overall package, the support member may include a sealant film.

As used herein, the phrase "sealant film" refers to a film which is conformably bonded to at least one of the exterior surfaces of a product support member. Preferably, the sealant film is bonded to the upper, as opposed to the lower, exterior surface of the support member and is a substantially gas-impermeable film.

"Orientation" involves stretching a film at an elevated temperature (the orientation temperature) followed by setting the film in the stretched configuration (e.g., by cooling). When an unrestrained, non-annealed, oriented polymeric film subsequently is heated to its orientation temperature, heat shrinkage occurs and the film returns almost to its original, i.e., pre-oriented, dimensions.

An oriented film has an "orientation ratio", which is the multiplication product of the extent to which the film has been expanded in several directions, usually two directions perpendicular to one another. Expansion in the longitudinal direction, sometimes referred to as the machine direction, occurs in the direction the film is formed during extrusion and/or coating. Expansion in the transverse direction means expansion across the width of the film and is perpendicular to the longitudinal direction. Thus, if a film has been oriented to three times its original size in the longitudinal direction (3:1) and three times its original size in the transverse direction (3:1), then the overall film has an orientation ratio of 3×3 or 9:1.

As used herein, the term "heat-seal" (also known as a "heat-weld") refers to the union of two films by bringing the films into contact, or at least close proximity, with one another and then applying sufficient heat and pressure to a predetermined area (or areas) of the films to cause the contacting surfaces of the films in the predetermined area to become molten and intermix with one another, thereby forming an essentially inseparable bond between the two films in the predetermined area when the heat and pressure are removed therefrom and the area is allowed to cool. In accordance with the practice of the present invention, a heat-seal preferably creates a hermetic seal, i.e., a barrier to the outside atmosphere.

BRIEF DESCRIPTION OF THE FIGURES OF THE DRAWINGS

In the drawings which are appended hereto and made a part of this disclosure.

DETAILED DESCRIPTION OF THE INVENTION

Figure 1:
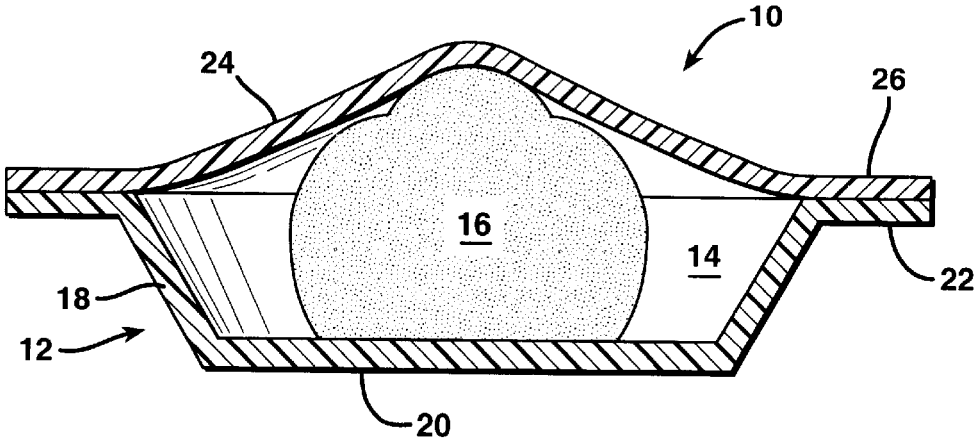
FIG. 1 is a cross-sectional view of a package in accordance with the present invention.

FIG. 1 illustrates package 10 which, in accordance with present invention, includes product support member 12 having a cavity 14 formed therein and a product 16 disposed within the cavity. Support member 12 is preferably in the form of a tray having side walls 18 and a base 20 which define the cavity 14, and further includes a peripheral flange 22 extending outwardly from the cavity. An upper web or film 24 encloses the product 16 within cavity 14 by being heat-welded to flange 22.

Upper film 24 is an oriented, heat shrinkable film which has been at least partially heat shrunk onto the upper portions of product 16 such that it is tensioned over the product and extends, in a tensioned fashioned to the flange of the support member in a manner which presents an in-store overwrapped appearance. The process by which the film is at least partially heat shrunk onto the product, an upwardly, heated drawing of the film over the support member and product, is described in greater detail below with reference to FIGS. 2–10 of the drawing.

The film required for use in such a process has been found in accordance with the present invention to be a film oriented to an extent sufficient to shrink onto and about the product in the desired manner but not so oriented that it cannot withstand the upward forming process. That is, films having an orientation ratio of 25.0:1 are useful in a variety of packaging applications. However, such films have been found to be oriented to too great an extent to,be appropriate for use in the present packaging process. Rather, films in accordance with the present inventions preferably have an orientation ratio in the range of from about 6.0:1 to about 16.0:1, more preferably from about 9.0:1 to about 14.0:1, most preferably from about 11.0:1 to about 13.0:1.

Preferably, film 24 is cross-linked in order to facilitate orientation. A variety of methods for cross-linking polymeric films are known in the art and are appropriate for use in forming the present film. Most preferably, film 24 is irradiated.

Upper web 24 may be a gas-permeable film, although it is preferably a substantially gas-impermeable film which optionally may delaminate into a substantially gas-impermeable portion and a gas permeable portion. In an alternative embodiment, two films, one which is gas-permeable and one which is substantially gas-impermeable may form upper web 24 such that removal of the substantially gas-impermeable film from the package leaves the gas-permeable film intact in order to effect a environmental change during the distribution cycle as may be desirable and as is discussed in greater detail below. For such alternative, the two films may be upwardly formed and sealed together or the underlying gas permeable film may be a heat shrinkable film which is upwardly formed in accordance with the present inventive process and the overlying substantially gas-impermeable film, which may be heat shrinkable or non-heat shrinkable may be applied to the package in a separate step, either by the present inventive process or by any process. For example, the substantially gas-impermeable film may be applied by the process described in U.S. Pat. No. 5,591,468, the disclosure of which is hereby incorporated by reference. Alternatively, the outer substantially gas-impermeable film may be overwrapped about the package. The appearance of the outer film for such embodiment is of little concern since it will be removed prior to retail display.

In a preferred embodiment, however, it is preferred that upper web 24 is a single film which is primarily polyolefinic in composition. However, any thermoplastic resins which possess properties desirable for packaging a particular product and which are capable of forming a film which may be oriented to the required extent are also appropriate for use in the present film. Barrier resins which are appropriate for rendering the film substantially gas-impermeable include vinylidene chloride copolymers, ethylene vinyl alcohols, and certain polyamides, among others.

The sealant layer must comprise one or more resins which are heat sealable to the support member or to a sealant film bonded to the support member. If the film itself is gas-permeable or if the sealant layer is a component of a gas-permeable portion of a peelable film as discussed herein, then the resin or resin blend of that layer also should have a relatively high gas transmissibility. Preferred resins for use in the sealant layer include copolymers of ethylene and a comonomer selected from vinyl acetate, alkyl acrylate, alpha-olefin, and acrylic acid. Sealability will depend, of course, on the composition of the sealing surface of the support member. Thus, for example, for a polystyrene support member which does not include a sealant film, an ethylene/styrene copolymer, either alone or in a blend with another polyolefin, preferably an ethylene copolymer, is an appropriate sealant layer for film 24.

Other layers may be included which are comprised of polymeric materials which impart desired properties to the overall film.

For example, one or more core layers which add mechanical strength, thickness, or machinability may be desired. For peelable films which may be separated into a substantially gas-impermeable portion and a gas-permeable portion, two interior, adjacent layers which, to a degree, are incompatible with each other must be included in order to provide a plane along which the two film portions may be separated. These layers may and preferably do serve some other function in the film. For example, the gas barrier layer may be adjacent to and slightly incompatible with the sealant layer such that the substantially gas-impermeable portion of the film may be peeled away and leave a monolayer film which is the sealant layer on the package. The operability of such peelable films is discussed in greater detail below.

Also, the outermost layer, that is, the surface of the film opposite from the sealant layer, preferably includes a resin or resin blend which is heat resistant since this is the surface of the film which will be heated during the package forming process and which will contact the sealing device during heat sealing of the film to the support member. Resins which are known to impart heat resistance as well as impact resistance properties to films include high density polyethylene, certain nylons, polypropylene, and styrene-containing polymers, among others.

Upper web 24 and support member 12 preferably form a substantially gas-impermeable enclosure for product 16 which substantially completely protects the product from contact with the surrounding environment including, in particular, atmospheric oxygen, but also including dirt, dust, moisture, microbial contaminates, etc., especially when product 16 is a food product. When product 16 is oxygen-sensitive, i.e., perishable, degradable, or otherwise changeable in the presence of oxygen, such as fresh red meat products (e.g., beef, veal, lamb, pork, etc.), poultry, fish, cheese, fruits, or vegetables, it is preferred that product 16 be packaged in a low-oxygen environment within package 10 to maximize the shelf-life of the product.

In a preferred embodiment, upper film 24 is a coextruded, multilayer film. Most preferably, it is a substantially gas-impermeable film which can be delaminated into a substantially gas-impermeable film portion and a gas-permeable film portion. It is preferred that the sealant layer is a part of the gas-permeable film portion such that when the gas-impermeable film portion is removed from package 10, only the gas-permeable portion of upper film 24 remains attached to support member 12. In this manner, product 16 remains fully enclosed within package 10, i.e., the gas-permeable portion is still heat-welded to flange 22 of support member 12 via heat seal 26 and continues to protect the product from microbial and other contaminates. However, atmospheric oxygen can now enter the cavity 14 of package 10 through the now-exposed gas-permeable portion. If product 16 is a fresh red meat product originally packaged in a gas which is lower in oxygen content than air, the increased rate of gas-transmission through the gas-permeable film portion results in a faster exchange of atmospheric oxygen for the packaging gas, thereby leading to a more rapid blooming of the fresh red meat product. In this manner, package 10 can more rapidly be displayed for consumer purchase, i.e., the delay time in waiting for the fresh red meat product to bloom to an acceptable color of red is reduced. This is an advantageous feature of the present invention.

Heat seal 26 bonds upper web 24 to flange 22 of support member 12. Although flange 22 is illustrated as a simple, single-surface flange, various flange configurations are possible, and the upper web 24 may be bonded to any desired upper surface thereof (i.e., generally upward facing surface of the flange as determined when the support member is in an upright position as shown). Heat seal 26 extends continuously around the upper surface of flange 22 to thereby hermetically seal product 16 within package 10.

Support member 12 optionally includes a sealant film (not shown) bonded to cavity 14 and to the upper surface of flange 22. In this manner, the upper surface of the sealant film defines the uppermost surface of support member 12 which is thereby in direct contact with product 16 in cavity 14 and in contact with upper web 24 on the upper surface of flange 22. More specifically, upper web 24 is actually bonded, via heat seal 26, to the upper surface of the sealant film at flange 22. Thus, it is preferred that the sealant film fully lines, i.e., is conformably bonded to, the entire upper surface of support member 12. If desired, a second sealant film may be bonded to the lower surface of support member 12. It is to be understood that, although it is not required for support member 12 to include a sealant film, it is preferable to include such a sealant film as a liner for at least the upper surface of support member 12 as a means to improve the functional characteristics of the support member when such improvement is deemed necessary or desirable. For example, if the support member is constructed of a material which is not sufficiently gas-impermeable for the intended package application, a sealant film which provides the required degree of gas-impermeability may be employed. A sealant film may also be used to improve the bond-strength of the heat seal 26, i.e., when the upper web and support member are constructed of materials which are not readily capable of forming a sufficiently strong heat seal, a sealant film may be used which both bonds well to the upper surface of the support member and also forms a strong heat-weld with the upper web.

Support member 12 can have any desired configuration or shape, e.g., rectangular, round, oval, etc. Similarly, flange 22 may have any desired shape or design, including a simple, substantially flat design which presents a single sealing surface as shown, or a more elaborate design which presents two or more sealing surfaces, such as the flange configurations disclosed in U.S. Pat. Nos. 5,348,752 and 5,439,132, the disclosures of which are hereby incorporated herein by reference. The flange may also include a peripheral lip positioned adjacent and exterior to the sealing surface to facilitate the peelable delamination of upper 24, such as disclosed in U.S. Ser. No. 08/733,843, entitled PACKAGE HAVING PEEL INITIATION MECHANISM and filed Oct. 18, 1996, the disclosure of which is hereby incorporated herein by reference.

Suitable materials from which support member 12 can be formed include, without limitation, polyvinyl chloride, polyethylene terephtlialate, polystyrene, polyolefins such as high density polyethylene or polypropylene, paper pulp, nylon, polyurethane, etc. The support member may be foamed or non-foamed as desired, and preferably provides a barrier to the passage of oxygen therethrough, particularly when product 16 is a food product which is oxygen-sensitive. When such oxygen-sensitive products are to be packaged in a low-oxygen environment (to thereby extend their shelf-life), support member 12 preferably allows less than or equal to about 1000 cc of oxygen to pass, more preferably less than about 500 cc of oxygen, more preferably still less than about 100 cc, even more preferably less than about 50 cc, and most preferably less than about 25 cc of oxygen to pass per square meter of material per 24 hour period at 1 atmosphere and at a temperature of 73° F. (at 0% relative humidity). Support member 12 may be formed from a material which itself provides a barrier to the passage of oxygen, e.g., vinylidene chloride copolymer, nylon, polyethylene tereplithalate, ethylene/vinyl alcohol copolymer, etc. Alternatively, support member 12 may have a substantially gas-impermeable sealant film laminated or otherwise bonded to the inner or outer surface thereof as described above, and as also disclosed in U.S. Pat. Nos. 4,847,148 and 4,935,089, and in U.S. Ser. No. 08/326,176, filed Oct. 19, 1994 and entitled "Film/Substrate Composite Material" (published as EP 0 707 955 A1 on Apr. 24, 1996), the disclosures of which are hereby incorporated herein by reference. The sealant film preferably includes an oxygen-barrier material such as e.g., vinylidene chloride copolymer (saran), nylon, polyethylene terephthalate, ethylene/vinyl alcohol copolymer, etc.

As is discussed in greater detail below, a packaging method in accordance with the present invention preferably includes, prior to enclosing the product within the support member, the step of at least partially evacuating the cavity of air and then at least partially filling the cavity with a desired gas, preferably one which is lower in oxygen content than air. In the case where a fresh red meat product is to be packaged. the amount of air removed preferably ranges from about 99% to about 99.999%, and more preferably from about 99.5% to about 99.999% by volume. Preferred gases to replace the evacuated air include, e.g., carbon dioxide, nitrogen, argon, etc., and mixtures of such gases. As a result of these steps, the cavity 14 of package 10 will preferably contain, prior to delamination of upper film 24, less than 1% oxygen by volume, more preferably less than 0.5% oxygen, even more preferably less than 0.1% oxygen, and most preferably, less than 0.05% oxygen by volume, with the balance comprising a gas or mixture of gases, such as a mixture of carbon dioxide and nitrogen. When package 10 provides a substantially gas-impermeable enclosure, such a modified-atmosphere packaging environment ensures that a packaged fresh red meat product will have a shelf-life of at least seven days, more preferably at least ten days and, even more preferably at least fourteen days, and most preferably at least twenty one days (assuming, of course, that the package is maintained under refrigerated conditions, e.g., at temperatures ranging from about 28° F. to about 48° F.).

As mentioned above, when a fresh red meat product is maintained in a low-oxygen environment, it has a dark red color which is aesthetically unappealing to most consumers. Thus, the final preferred step (or one of the final steps) in a packaging method according the present invention is to peelably remove the gas-impermeable film portion of upper film 24, whereby air enters cavity 14 through the remaining, gas-permeable portion of film 24 and displaces at least some of the gas which is lower in oxygen content than air. In this manner, atmospheric oxygen is permitted to come into contact with the packaged fresh red meat product and cause it to bloom to a bright red color which consumers associate with freshness.

The process for making package 10 in accordance with the present invention is best understood from a review of FIGS. 2–6. These figures show product 16 contained on support member 12 within vacuum chamber 30. The vacuum chamber includes upper chamber 40 and lower chamber 50. Upper chamber 40 includes dome 42, heating rods 44 positioned within dome compartment 45, channels 46, and port 48. Lower chamber 50 includes lower support 52 in which is nested support member 12 and which is movably carried on support rods 54. Lower chamber 50 also includes ports 56 and 58.

Figure 2:
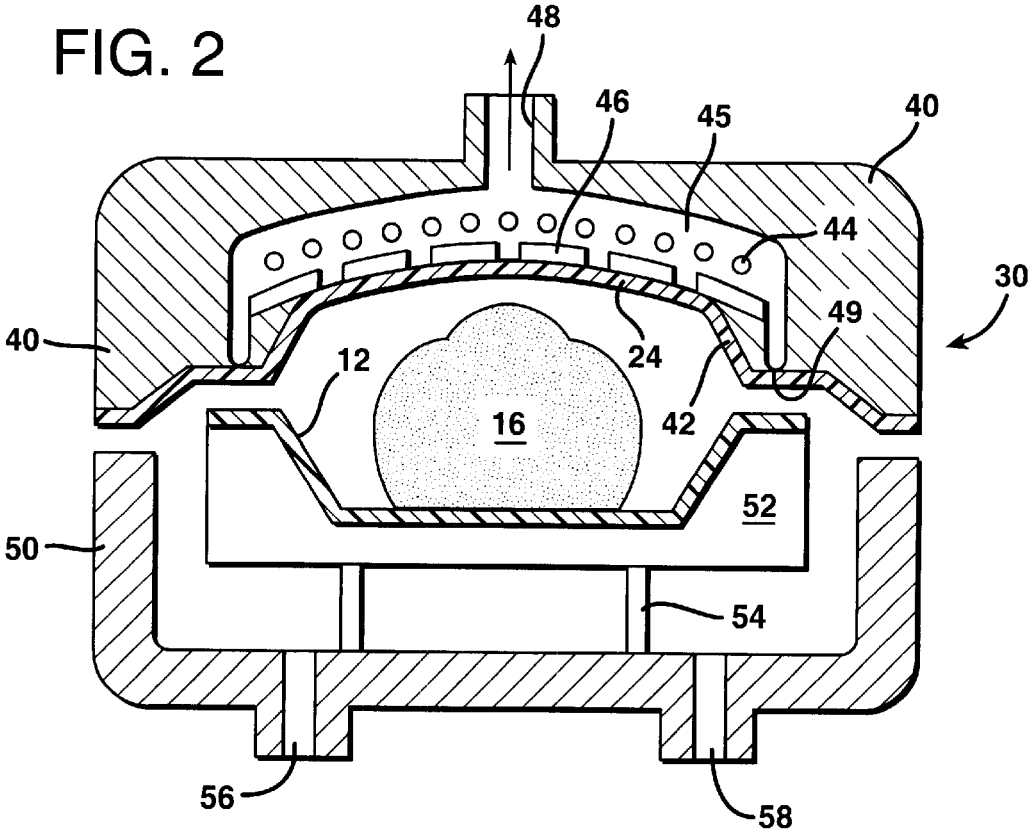
FIG. 2 is a cross-sectional view of a vacuum chamber employed in accordance with the present invention wherein the oriented upper web is being drawn by differential pressure into a concavity.

Looking specifically to FIG. 2, support member 12 containing product 16 is contained on lower support 52. Upper film 24 preferably has been preheated, either by radiant means or hot air blowing, prior to extension into the vacuum chamber or by residual heat from dome 42 within the vacuum chamber. Because film 24 is an oriented, heat shrinkable film, it must be restrained during any preheating step to prevent shrinking at that step of the process.

As is shown in FIG. 2, film 24 is then drawn upwardly into a concavity formed by dome 42 by a vacuum, shown by an arrow, drawn through port 48 and, consequently, channels 46. Heating rods 44 heat film 24 to a desired temperature. The desired temperature to which the film 24 is heated will depend, of course, on the composition of the film. Generally, the dome should be heated to a temperature of from about 85° C. to about 150° C., more preferably from about 100° C. to about 130° C. The temperature needs to be sufficiently high to enable the film to seal, with pressure to the underlying support member and to shrink when released from the heated dome.

Figure 3:
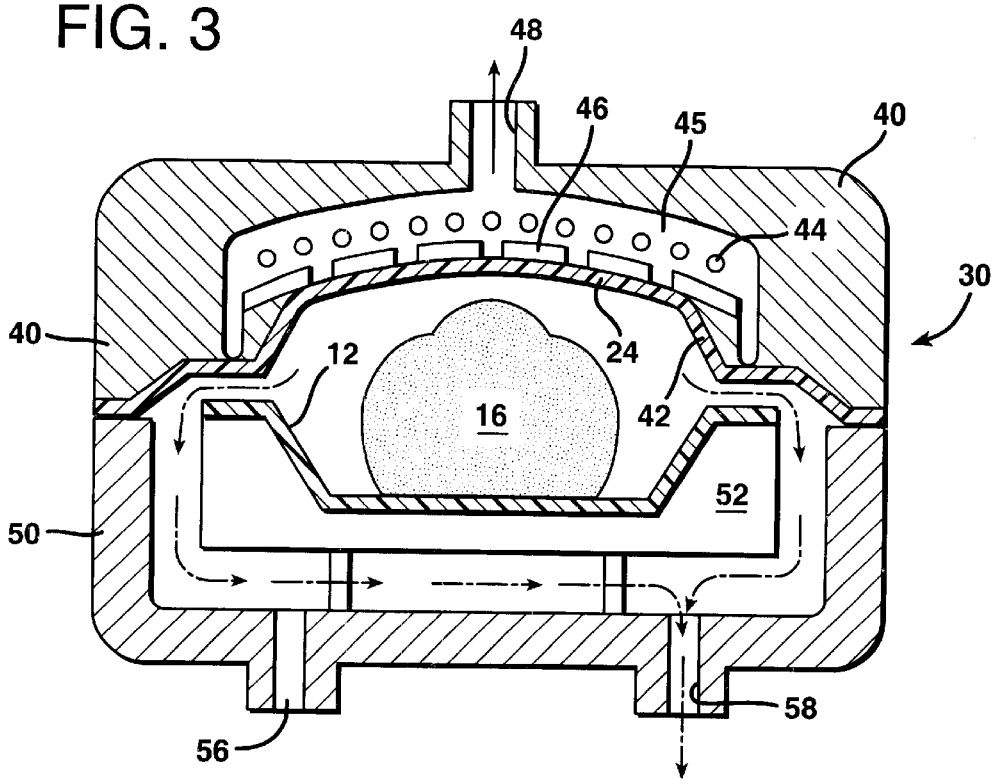
FIG. 3 is a cross-section view of the vacuum chamber of FIG. 2 undergoing evacuation.

Looking now to FIG. 3, while the film 24 is held, by vacuum, against heated dome 42, the vacuum chamber is closed, preferably by the upper chamber moving downwardly to close against the lower chamber. The chamber, including the space between support member 12 and upper film 24, is then evacuated, as is shown by arrows, by a vacuum drawn through port 58.

Figure 4:
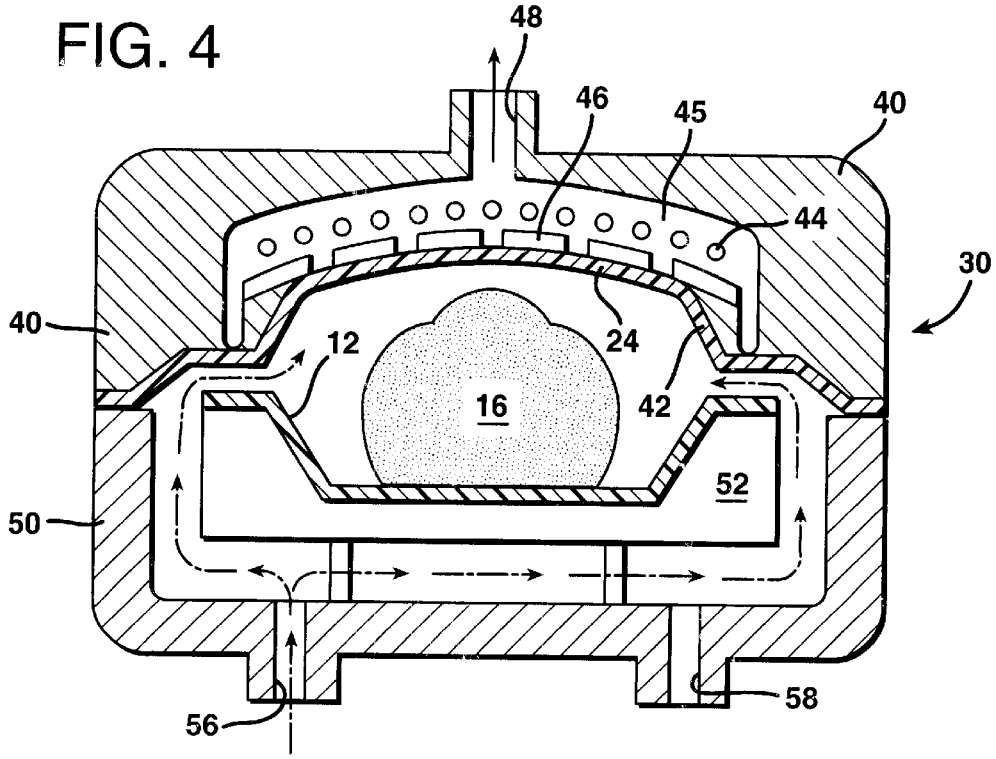
FIG. 4 is a cross-sectional view of the vacuum chamber of FIG. 3 after evacuation during the introduction of a desired gas.
Figure 5:
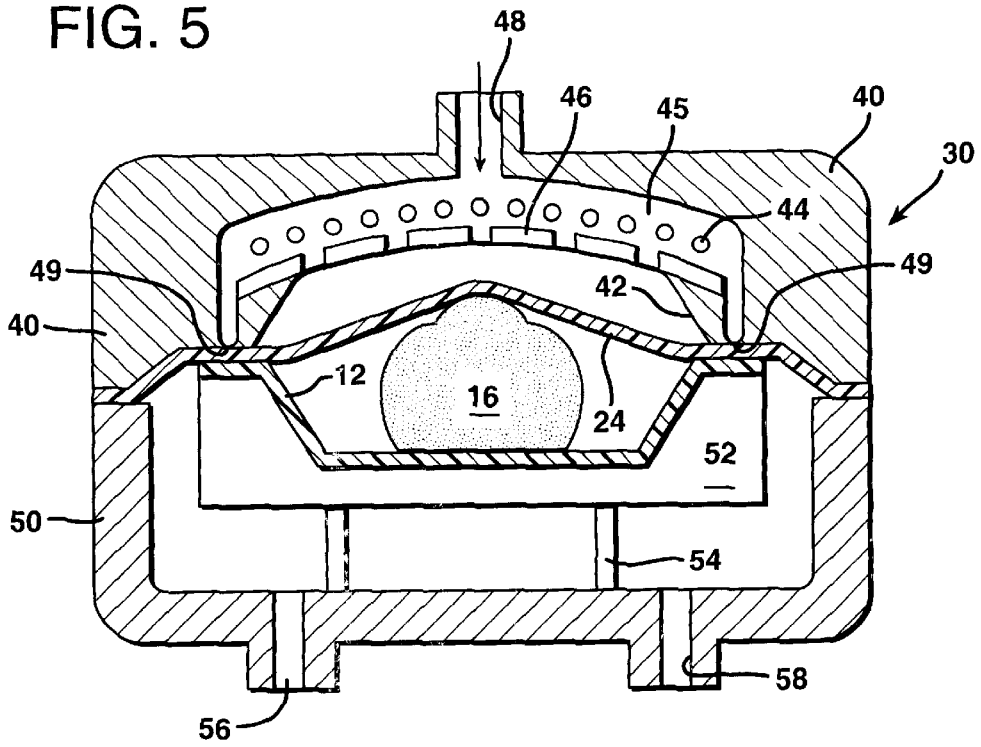
FIG. 5 is a cross-sectional view of the vacuum chamber of FIG. 4 wherein the heated, oriented film is released and allowed to shrink onto the uppermost portions of the underlying high profile product.

When evacuation of the chamber is complete, port 58 is closed and a desired gas is flushed into the chamber via port 56, as is shown by arrows in FIG. 4, to the desired pressure around product 16.

When the desired gas pressure is reached within the chamber, lower support 52 is moved upward by support rods 54 to push the support member 12 against sealing flanges 49 in order to heat seal, by pressure, film 24 to support member 12. Immediately following upward positioning of the support member, the vacuum at port 48 is released, thereby allowing the film to drape and shrink over the product and the gas contained around the product.

Figure 6:
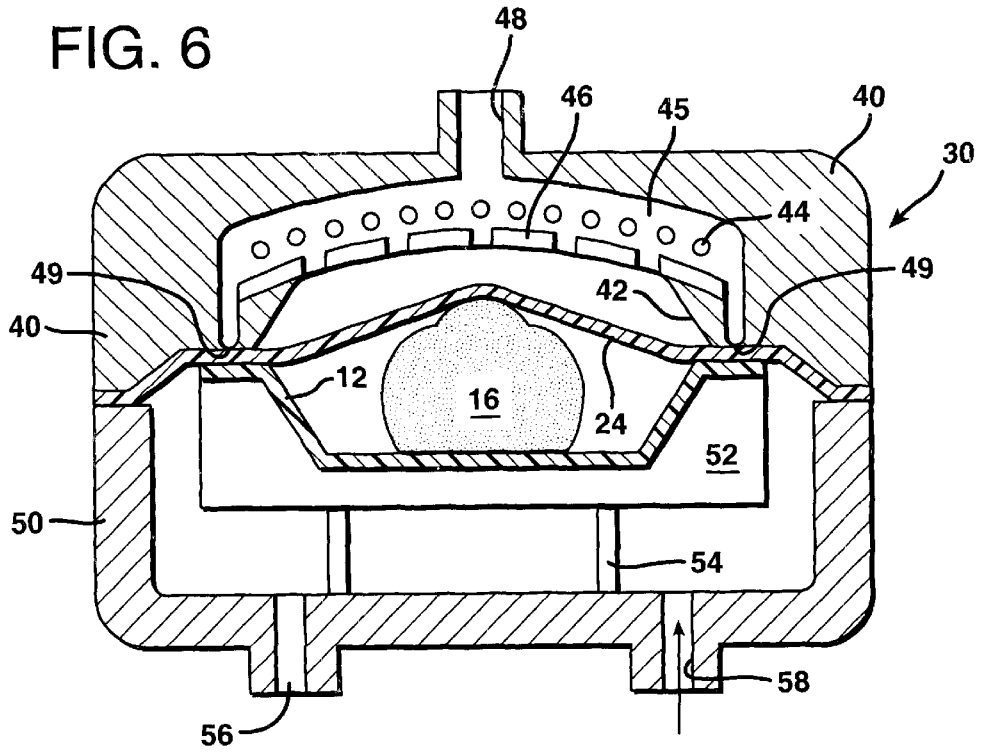
FIG. 6 is a cross-sectional view of the vacuum chamber of FIG. 5 showing completion of the packaging cycle.

As is shown in FIG. 6, once the film is shrunk onto the product and sealed to the flange of the support member, the lower chamber is opened to atmospheric pressure via port 58. Upper chamber 40 is raised and lower support 52 is lowered to complete the cycle. The package is then removed from the vacuum chamber to trim excess film.

FIGS. 7–10 illustrate an alternative vacuum chamber which provides for the formation of several packages in accordance with the present invention in one cycle. Vacuum chamber 130 includes upper chamber 140 and lower chamber 150. The upper chamber includes a plurality of domes 142, heating rods 144 positioned within dome compartment 145, channels 146, and port 148. Lower chamber 150 includes lower support 152 which is movably carried on support rods 154. Support members 112 are nested within the cavities 153 of lower support 152. For the present embodiment it is preferred that the support members 112 are thermoformed in-line with the packaging process such that a plurality of such support members have been formed from a single thermoformable sheet. However, it is also possible to provide individual trays to be packaged, in a group, in vacuum chamber 130. As above, lower chamber 150 also includes ports 156 and 158.

Figure 7:
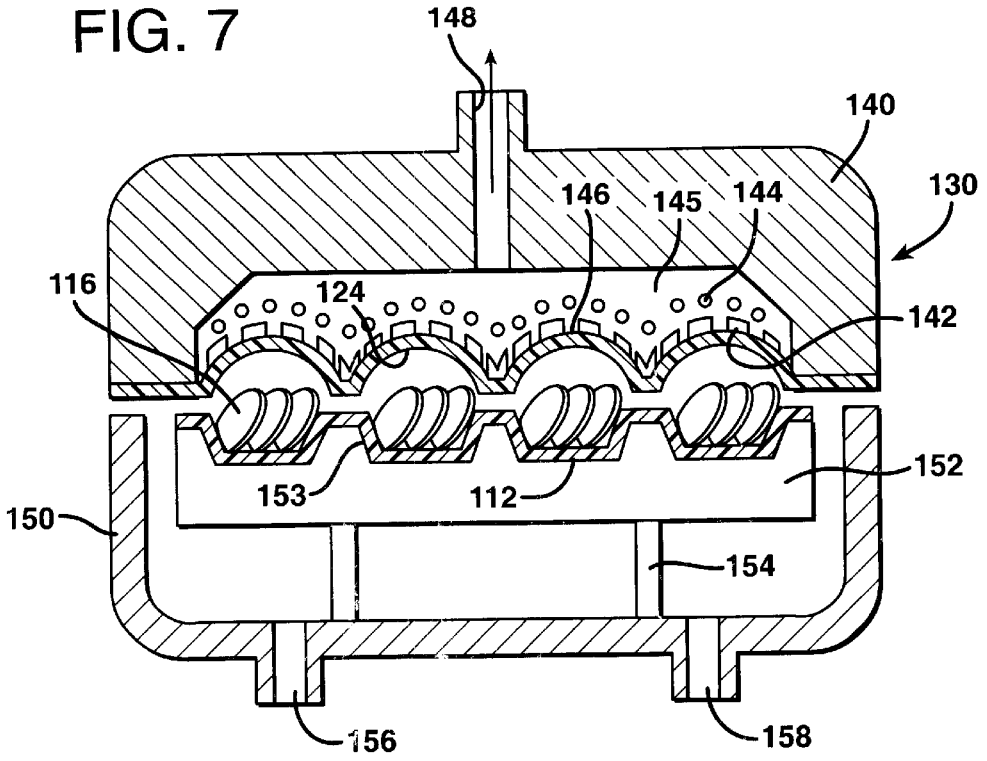
FIG. 7 is a cross-sectional view of an alternative vacuum chamber in accordance with the present invention wherein an oriented upper web is being drawn by differential pressure into a plurality of concavities for forming several packages.

Looking specifically to FIG. 7, support members 112 containing products 116 are contained within the cavities 153 of lower support 152. Upper film 124 preferably has been preheated, as described above.

As is shown in FIG. 7, film 124 is then drawn upwardly into a concavity formed by domes 142 by a vacuum, shown by an arrow, drawn through port 148 and, consequently, channels 146. Heating rods 144 heat film 124 to a desired temperature, as described above.

Figure 8:
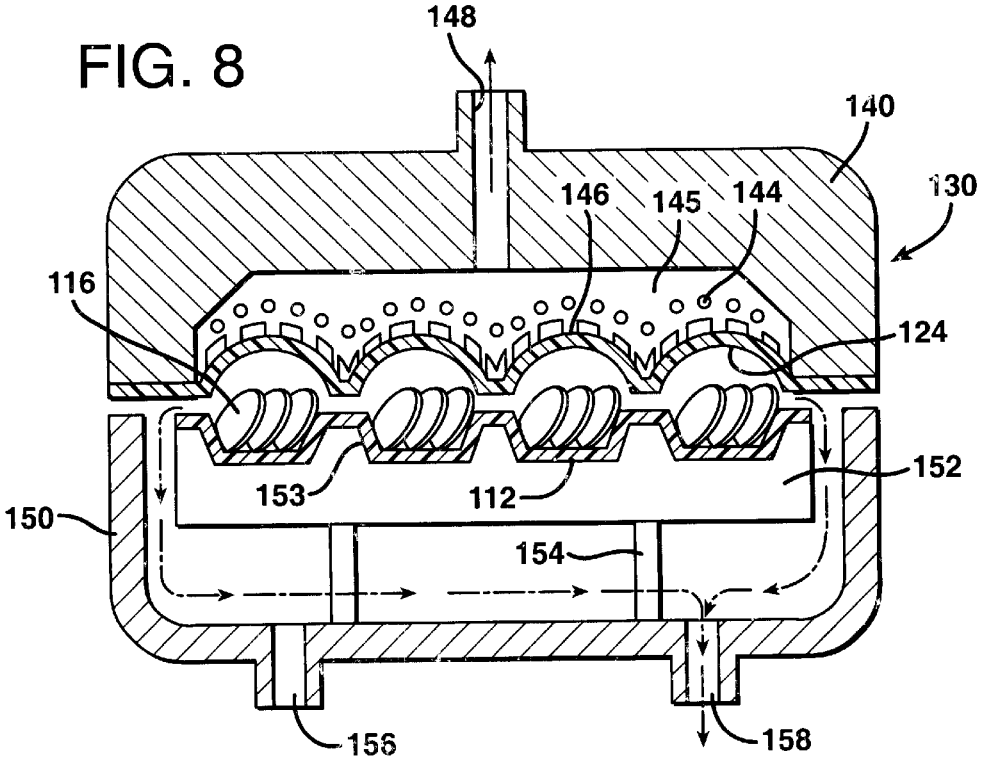
FIG. 8 is a cross-sectional view of the vacuum chamber of FIG. 7 undergoing evacuation.

Looking now to FIG. 8, while the film 124 is held, by vacuum, against heated domes 142, the vacuum chamber is closed, preferably by the upper chamber moving downwardly to close against the lower chamber. The chamber, including the space between support members 112 and upper film 124, is then evacuated, as is shown by arrows, by a vacuum drawn through port 158.

Figure 9:
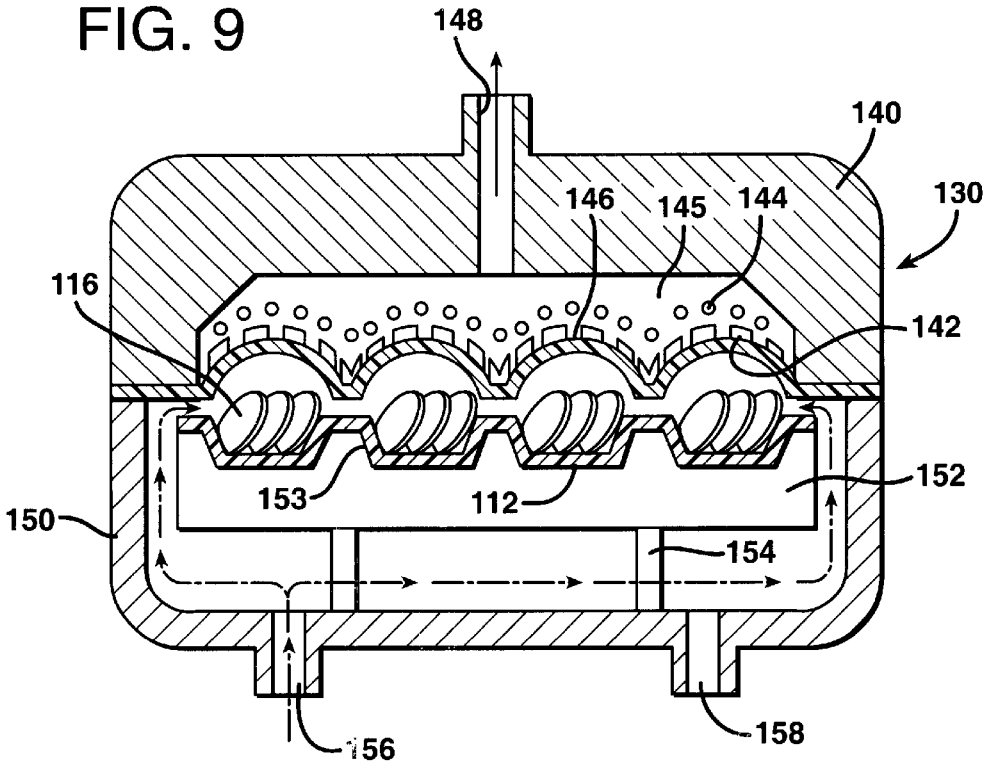
FIG. 9 is a cross-sectional view of the vacuum chamber of FIG. 8 after evacuation during the introduction of a desired gas.
Figure 10:
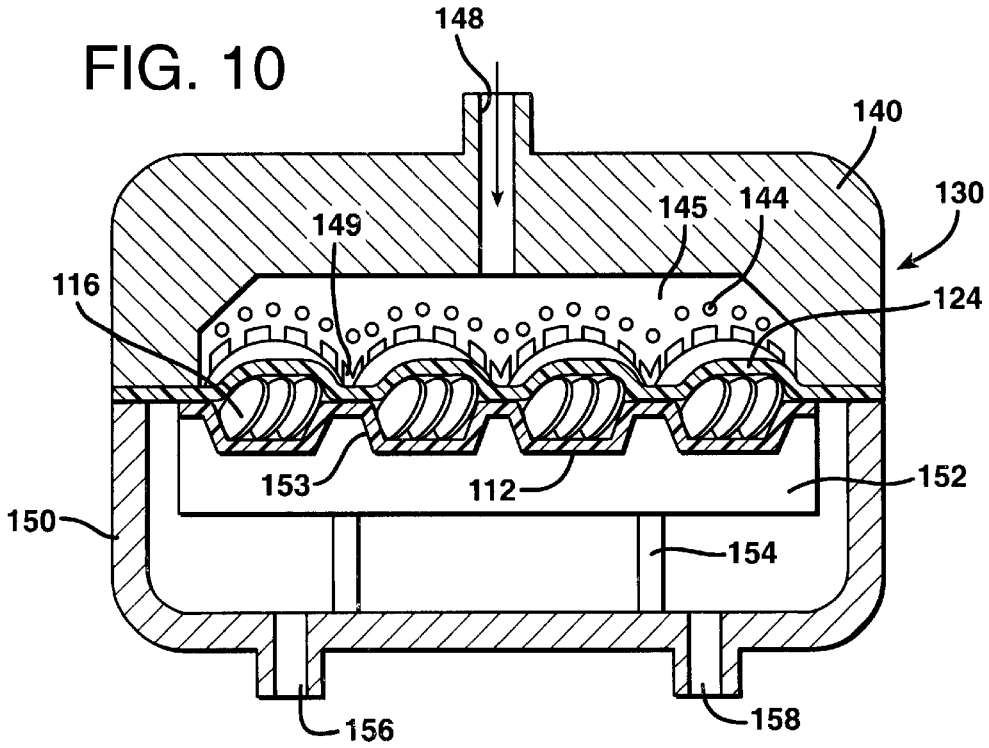
FIG. 10 is a cross-sectional view of the vacuum chamber of FIG. 9 wherein the heated, oriented film is released and allowed to shrink onto the uppermost portions of the underlying high profile products.

When evacuation of the chamber is complete, port 158 is closed and a desired gas is flushed into the chamber via port 156, as is shown by arrows in FIG. 9, to the desired pressure around products 116.

When the desired gas pressure is reached within the chamber, lower support 152 is moved upward by support rods 154 to push the support members 112 against sealing flanges 149 in order to heat seal, by pressure, film 124 to support members 112. Immediately following upward positioning of the support member, the vacuum at port 148 is released, thereby allowing the film to drape and shrink over the product and the gas contained around the product. Thereafter, the lower chamber is opened to atmospheric pressure via port 158. Upper chamber 140 is raised and lower support 152 is lowered to complete the cycle. The connected packages are then removed from the vacuum chamber to be cut into individual package and trimmed of excess film at the outer edges.

The invention may be further understood by reference to the following examples, which are provided for the purpose of representation, and are not to be construed as limiting the scope of the invention.

EXAMPLES

A comparison was made between four groupings of films: Comparative Example 1) a 3.5 mil barrier cast coextruded film; Comparative Example 2) a 6.0 mil peelable barrier cast coextruded film which was electronically cross-linked; Comparative Example 3) a barrier shrink film which was oriented to 25:1 ratio; and Example 4) two gas permeable shrink films sold under the trade names SSD330 and SSD331 by the Cryovac Division of Sealed Air Corporation., with and without antifog agent, respectively, oriented at approximately a 9:1 ratio.

The cast coextruded film of Comparative Example 1 could be formed into the dome, but had no shrink properties up to 150° C., giving a loose, wrinkled appearance. At temperatures above 150° C., the film melted and was unacceptable. The peelable, cross-linked cast coextruded film of Comparative Example 2 also presented a loose, wrinkled appearance at temperatures up to 150° C. It survived temperatures up to 180° C., but the resulting package gave a skin packaged appearance and was not a taut film overwrap appearance. The highly oriented film of Comparative Example 3 did not thermoform into the dome due to the high orientation and consequently ruptured and was not useful. Finally, the films of Example 4 which were oriented to 9:1 ratio were successfully preheated by the dome, then drawn upwardly into the dome at a range of temperatures of 93° C. to 121° C., and sealed to the rigid tray flange, with a taut shrunk film appearance on the finished package when released from the dome, by way of heat from the dome.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A packaging process, comprising:

a) providing a support member comprising a product support surface and a periphery;

b) providing a film comprising a sealant layer, the sealant layer being sealable to the support member;

c) orienting the film to an-orientation ratio of from about 6.0:1 to about 16.0:1;

d) positioning a product on the product support surface of the support member such that at least a portion of the product extends upwardly above the level of the periphery;

e) extending the film above the support member and product, the sealant layer being immediately above and adjacent to the support member and the product;

f) drawing the film into a concavity by differential pressure;

g) maintaining the concave shape of the film while heating the film;

h) removing gases from the space between the film and the support member and product;

i) introducing a desirable gas into said space;

j) releasing the film such that it moves toward the product and the support member, the desirable gas being retained within the space precluding close contact of the film with the lowermost portions of the product; and k) sealing the film to the periphery of the support member, wherein at least the steps of heating the film shrinks the film, thereby tensioning it onto and across the underlying product.

2. The process set forth in claim 1 wherein the support member comprises a downwardly formed cavity and an upper flange, said downwardly formed cavity comprising the product support surface and said upper flange defining the periphery of the support member.

3. The process set forth in claim 1 wherein the film is oriented to an orientation ratio of from about 9.0:1 to about 14.0:1.

4. The process set forth in claim 3 wherein the film is oriented to an orientation ratio of from about 11.0:1 to about 13.0:1.

5. The process set forth in claim 1 wherein the step of maintaining the concave shape of the film while heating the film comprises heating the film to a temperature of from about 85° C. to about 150° C.

6. The process set forth in claim 5 wherein the step of maintaining the concave shape of the film while heating the film comprises heating the film to a temperature of from about 100° C. to about 130° C.

7. The process set forth in claim 1 wherein the step of providing a film comprises providing a peelable film separable into a substantially gas permeable portion and a substantially gas impermeable portions, wherein the sealant layer comprises a layer of the substantially gas permeable portion of the film and further including the step of peelably removing the substantially gas-impermeable portion from the package.

8. The process set forth in claim 1 further including the step of preheating the film prior to the step of drawing the film into a concavity.

* * * * *